United States Patent [19]

Robinson

[11] 4,094,101

[45] June 13, 1978

[54] ICE-SKATE SHARPENER

[76] Inventor: Bertrand Robinson, 4455 de la Naudiére Street, Montreal, Canada

[21] Appl. No.: 783,897

[22] Filed: Apr. 1, 1977

[30] Foreign Application Priority Data

Apr. 1, 1976 United Kingdom ..... 13178/76

[51] Int. Cl.[2] ..... B24B 53/06

[52] U.S. Cl. ..... 51/5 D; 51/228; 269/238

[58] Field of Search ..... 51/5 D, 91 BS, 92 BS, 51/96, 166 R, 228; 269/238, 242

[56] References Cited

U.S. PATENT DOCUMENTS

| | | | |
|---|---|---|---|
| 1,322,370 | 11/1919 | Strathern | 269/238 X |
| 3,118,256 | 1/1964 | DeWitt | 51/96 |
| 3,663,003 | 5/1972 | Morse | 269/242 X |
| 3,988,124 | 10/1976 | Babcock | 51/228 X |
| 3,988,865 | 11/1976 | Weisman | 51/228 |
| 4,055,026 | 10/1977 | Zwicker | 51/228 |

FOREIGN PATENT DOCUMENTS

| | | | |
|---|---|---|---|
| 874,727 | 7/1971 | Canada | 51/96 |

*Primary Examiner*—Gary L. Smith

[57] ABSTRACT

An ice-skate sharpener comprising a stationary electric motor grinder including a diamond bit carried by an arm pivoted on a support adjacent the grinding wheel and serving to dress the peripheral face of the grinding wheel to the desired transverse curvature, so that an ice-skate blade can be sharpened with the desired hollow ground. The sharpener further includes a pair of self-centering jaws to clamp the blade of an ice-skate therebetween and pivotally connected to the cuter end of articulated arms, themselves pivotally mounted on a support secured to the work bench of the sharpening assembly. The level of these arms can be adjusted to ring ice-skate blade carried by the jaws in exact alignment with the pivot of the arm supporting the diamond bit, so as to produce a hollow ground, which is exactly centered with respect to the side faces of the ice hockey blade. The jaws are self-centering so that the centered hollow ground is obtained independently of the thickness of the ice hockey blade. The support carrying the jaws is further insulated against vibration, so that perfect grinding of the ice-skate blade is obtained.

3 Claims, 5 Drawing Figures

ICE-SKATE SHARPENER

The present invention relates to an ice-skate sharpener of the type including a stationarily mounted power-driven grinding wheel, a means for dressing the peripheral grinding face of the wheel to the desired transverse curvature and an ice-skate support for bringing the ice-skate blade in grinding contact with the grinding wheel.

It is known that different makes of ice-skates have ice blades of different thicknesses, for instance varying between 110 and 130 thousandths of an inch. Yet it is often desired to sharpen the ice-skate blades so as to obtain a hollow ground. With existing ice-skate sharpeners, the clamp holding the ice-skate is not self-centering and, therefore, when the clamp is adjusted for an ice-skate blade of a given thickness to obtain centering of the hollow ground with respect to the blade, it will be no longer capable of producing a centered hollow ground with respect to the blade when the blade is of an increased or decreased thickness. There results, therefore, a fully sharpened ice-skate blade in that one lip of the hollow ground will be higher than the other lip.

It is therefore the general object of the invention to provide an ice-skate sharpener which produces a hollow ground, of any desired curvature, which is exactly centered with respect to the blade, irrespective of the thickness of the blade and without having to adjust the positioning of the ice-skate with respect to the grinding wheel every time another ice-skate blade sharpened.

Another object of the invention is to provide a sharpener of the character described, in which the ice-skate clamp is mounted for free displacement in all horizontal planes, so that the user can displace the ice-skate to another grinding wheel mounted adjacent the first wheel, so as to obtain a coarse grind and a fine grind, without having to unclamp the ice-skate.

The foregoing and other objects of the invention will become more apparent during the following disclosure and by referring to the drawings, in which.

In the drawings, like reference characters indicate like elements throughout.

Figure 1:
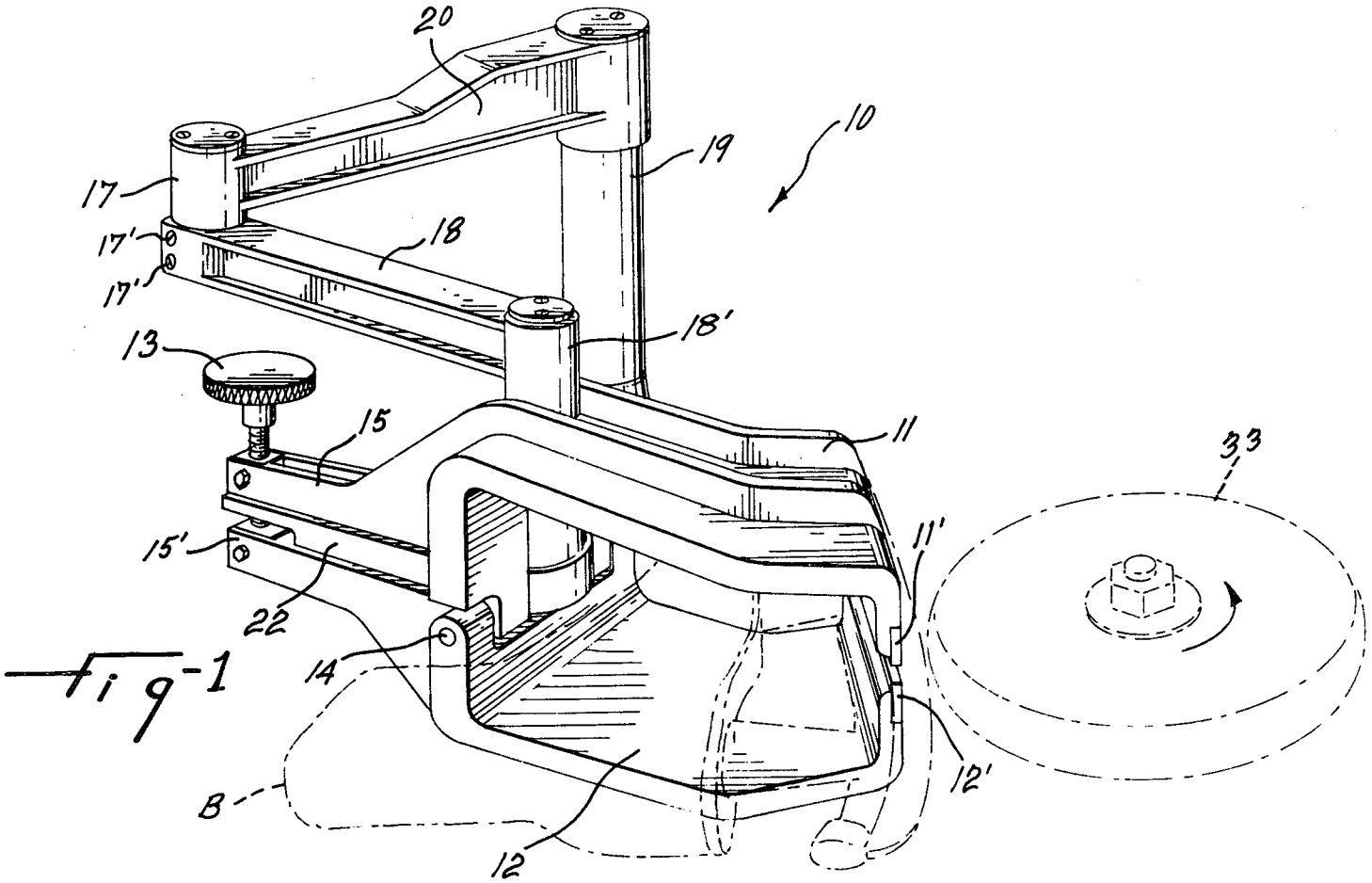
FIG. 1 is a perspective view of the sharpener of the invention showing the grinding stone in dot-and-dash line.
Figure 2:
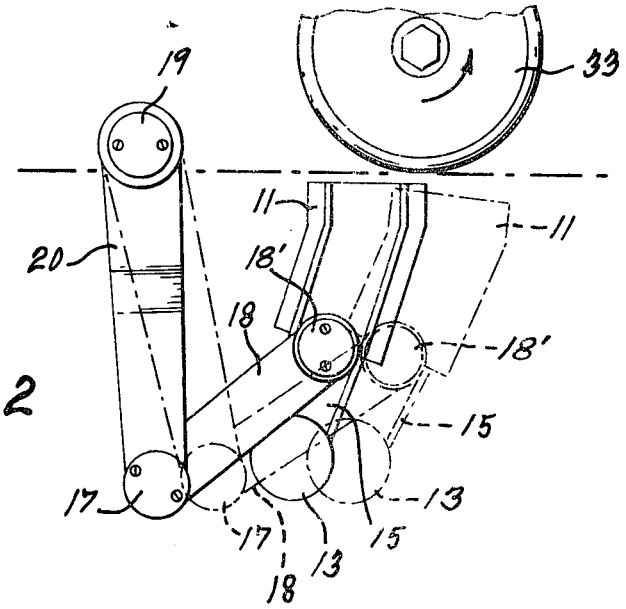
FIG. 2 is a schematic top plan view of the sharpener showing how the skate can be moved with respect to the grinding stone.

The device comprises a clamp and support assembly 10 including a pair of U-shaped jaws 11 and 12 adapted to encircle an ice-skate B and clamp the blade A of ice-skate B between edge faces 11 and 11' of said jaws. The upper and lower jaws 11 and 12 are pivotally connected by means of a transverse pin 14 to the corner of an angular support 21 and each has a rearward extension 15, 15' respectively, disposed over and underneath the rearwardly extending leg 22 of the angular support 21. The outer end of rearward leg extension 22 has a fork 23. The outer end of each extension 15, 15' is also forked and receives between its prongs a block 24, which is transversely pivoted about short pins 25. Each block 24 has a threaded through bore for receiving the thread portions 13', 13'' of a knurled screw 13. The threads 13' and 13'' are of opposite pitch and the knurled screw has a center portion 13''' extending between two spaced collars **13*a* and adapted to be received within the fork 23 of the rear extension 22. Thus, the knurled screw 13 can be rotated within fork 23 of the rear extension 22. Thus, the knurled screw 13 can be rotated within fork 23 while being prevented from axial movement relative to said extension 22. Rotation of the knurled screw in one direction will cause equal movement of the jaw extensions 15 and 15' away from each other, while rotation of the knurled screw in the opposite direction will cause equal movement of the jaw extensions 15 and 15' towards each other. Thus, the ice-skate blade contacting edge faces 11' and 12' of jaws 11 and 12 will move a precise amount towards or away from each other, while always remaining centered in the clamped position with respect to the leg extension 22**.

Figure 4:
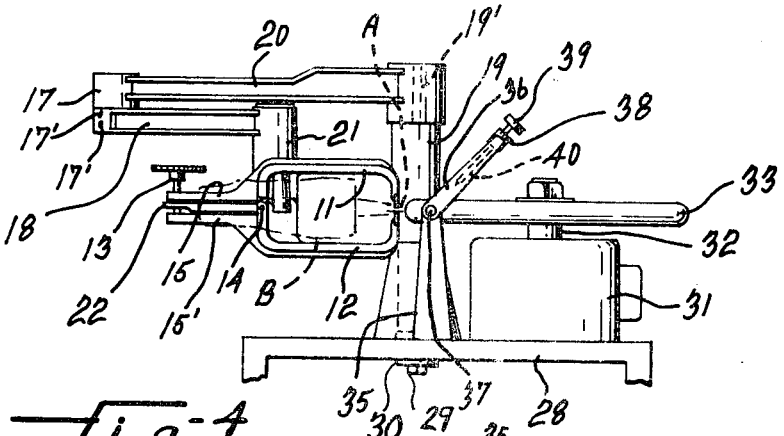
FIG. 4 is a side elevation of the entire sharpener arrangement.
Figure 5:
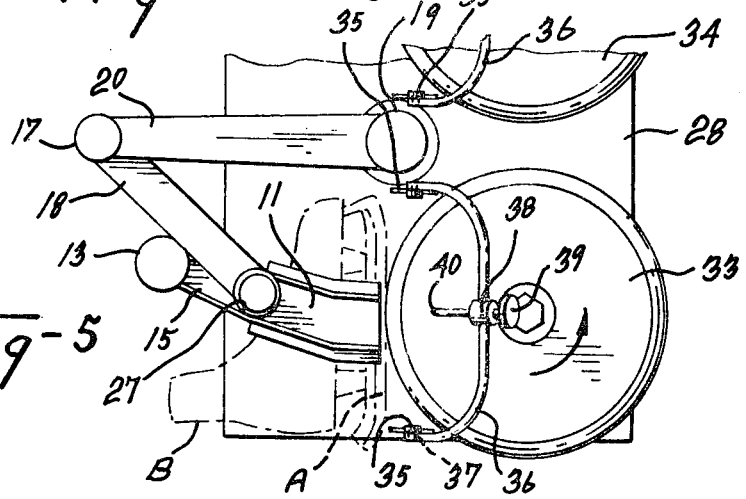
FIG. 5 is a top plan view of FIG. 4.
Figure 3:
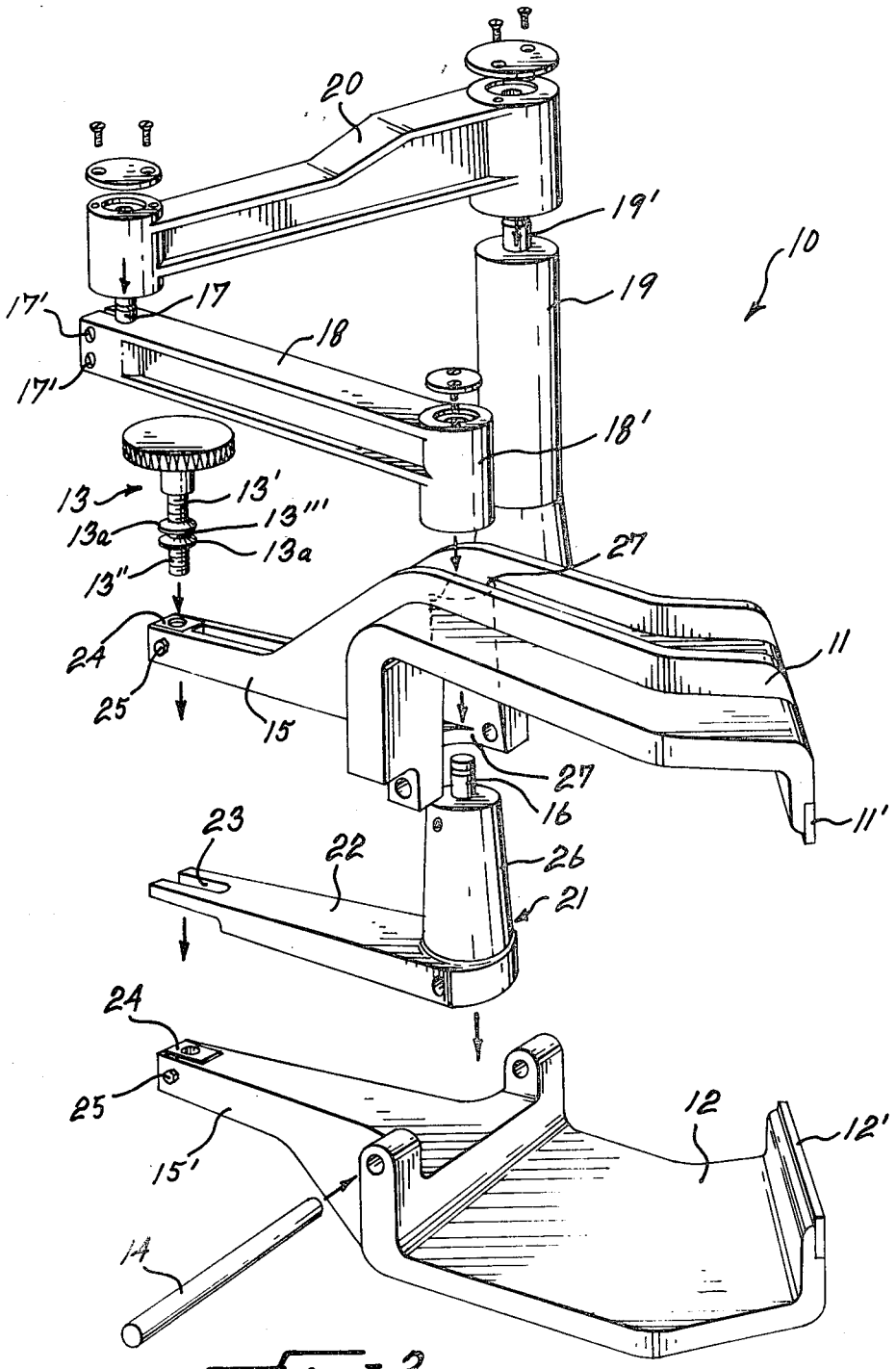
FIG. 3 is an exploded perspective view of the clamp and of its support.

The vertical leg 26 of the angular support 21 extends freely through a cavity 27 of the upper jaw 11 and is pivotally connected by spindle 16 to the bushing 18' formed at one end of a horizontal pivot arm 18. Bushing 18' houses a ball bearing arrangement (not shown). Similarly, the other end of pivot arm 18 is provided with a spindle 17, which can be vertically adjusted by means of setscrews 17'. Pivot pin 17 extends through a bushing and ball bearing arrangement at the lower end of a second horizontal pivot arm 20, itself pivotally mounted at its other end on the spindle 19' of a post 19, which upstands from the top of a work bench 28, as shown in FIG. 4 and is secured thereto by a bolt 29 with the interposition of fibre pads 30 to reduce the transmission of vibration from the work bench to the ice-skate blade A. Secured to the work bench is an electric motor 31 having its driving shaft 32 vertically disposed and mounting a grinding stone, or wheel 33. Normally, there are two grinding stone arrangements mounted side by side, one indicated at 33, being a coarse grinding stone, and the other one, indicated at 34, being a fine grinding stone.

The post 19 is preferably secured to the work bench 28 between the two grinding stones. Each grinding stone can be dressed at its peripheral face to any desired radius of curvature by means of a diamond bit arrangement. This arrangement comprises a pair of posts 35 upstanding from the work bench 28 on each side of the grinding wheel 33 or 34 and carrying a yoke 36 pivoted at its ends at 37 to the respective posts 35. All pivot axes 37, 37' for the two wheels 33 and 34 are in the same horizontal plane and perpendicular to the axes of the driving shafts 32 supporting the respective grinding wheels 33 and 34.

Each yoke 36 has a central threaded bushing, or enlargement 38, in which is threaded a knurled head screw 39 carrying a diamond bit 40.

It will be understood that with the ice-skate clamped out of the way, the yoke 36 can be pivoted around its pivotal axis 37 to dress up the peripheral face of the grinding wheel 28 in accordance with any desired curvature, depending on the longitudinal adjusted position of the diamond bit 40 with respect to the yoke.

In accordance with the invention, the ice-skate supporting clamp is adjusted so that the central plane of the clamped ice-skate blade A will pass through the pivotal axis 37 of the diamond bit supporting yoke 36, so as to be truly centered with respect to the radius of curvature of the peripheral face of the grinding wheel. In adjusted position of the clamp, the datum plane perpendicular axes 16, 17, 19' and 32 and passing through the closed jaw faces 11', also extends through yoke pivotal axes 37 and 37'.

The adjustment of the level of the clamp can be made, for instance, by adjusting the position of the spindle 17 with respect to the arm 18 by unscrewing and re-screwing the set screws 17'. Normally, such an adjustment is effected once when setting up the grinding machine. Once this is done, the clamp can take skates with blades of various thicknesses without any further adjustment.

To unclamp and clamp the ice-skate blade, it is only necessary to turn the knurled screw 13 in one direction or the other only a few turns. The skate blade is first ground on the coarse grinding wheel 33 and immediately after bodily displaced and ground on the finishing or fine grinding wheel 34, since the pivot axes 37' of its own diamond bit carrying yoke are at the same level as pivot axes 37.

Edge faces 11' and 12' of jaws 11 and 12 are straight and flat and engage the opposite side faces of ice-skate blade A with sufficient force to straighten said blade, if required.

What I claim is:

1. In an ice-skate sharpening machine including a frame, a grinding wheel rotatable about a rotation axis, a motor to rotate said wheel, a diamond bit for dressing said wheel, an arm pivoted to said frame about a pivot axis perpendicular to said rotation axis and carrying said bit in a position facing the peripheral face of said grinding wheel, so arranged that pivoting of said arm back and forth will dress said grinding wheel peripheral face along an arc of a circle lying in a plane containing said rotation axis, the improvement consisting in an ice-skate clamp comprising a bracket, a pair of jaws each pivoted on said bracket about a jaw pivotal axis lying in a plane perpendicular to said rotation axis and each having a straight jaw face for engaging an ice-skate blade, means to close and open said jaws and retain the same in adjusted pivotal position, so that said jaw clamping faces are always equally distant on each side of a datum plane perpendicular to said rotation axis and passing through said pivotal axis of said arm, means to adjust and set the position of said bracket in a direction parallel to the rotation axis of said grinding wheel, means supporting said bracket for universal movement in said datum plane, said jaws each having a U-shape to encircle an ice-skate, said ice-skate blade contacting jaw faces being located at the free edge of one leg of said U-shaped jaws, while said pivotal connection is located at the free edge of the other leg of said U-shaped jaws, and wherein said means to close and open said jaws include an extension for each jaw projecting away from the ice-skate blade contacting faces relative to said jaw pivotal axis, a threaded bushing carried by the outer end of each extension, said bracket having a leg extending between said jaw extensions, an adjusting screw having an intermediate portion rotatably mounted in the outer end of said bracket leg, means to prevent axial movement of said screw relative to said bracket leg, said screw having threads of opposite pitch on each side of said central portion respectively engaging the threaded bushing of the jaw extensions whereby rotation of said screw in one direction will open said jaws equally away from said datum plane and rotation of said screw in the opposite direction will close said jaws equally towards said datum plane.

2. In an ice-skate sharpening machine as claimed in claim 1, wherein said means supporting said bracket for universal movement in said datum plane include a post fixed to said frame and spaced from said grinding wheel, a first support arm and a second support arm serially pivotally connected to said bracket, to each other and to said post about parallel pivot axes, also parallel to said wheel rotation axis.

3. In an ice-skate sharpening machine as claimed in claim 2, further including a second grinding wheel rotatable about a second rotation axis, sapced from said first-named grinding wheel, and a second motor to rotate said second grinding wheel, a second diamond bit for dressing said second grinding wheel, a second arm pivoted to said frame about a pivot axis co-axial with the pivot axis of the diamond but carrying first-named arm, said clamp movable by means of said first and second support arms to bring an ice-skate blade clamped thereby in grinding position against the peripheral face of said second grinding wheel.

* * * * *